US011091951B2

(12) United States Patent
Pylypczak et al.

(10) Patent No.: US 11,091,951 B2
(45) Date of Patent: Aug. 17, 2021

(54) JAMB ASSEMBLY FOR A DOOR FRAME

(71) Applicant: Teknion Limited, Toronto (CA)

(72) Inventors: Mark Pylypczak, Mississauga (CA); Hugues Gagnon, Québec (CA); Richard Dubé, Lévis (CA); Zoran Baic, Mississauga (CA); Youssef Adib, Lévis (CA); Paul Kruger, Toronto (CA)

(73) Assignee: Teknion Limited, Toronto (CA)

( * ) Notice: Subject to any disclaimer, the term of this patent is extended or adjusted under 35 U.S.C. 154(b) by 3 days.

(21) Appl. No.: 16/686,685

(22) Filed: Nov. 18, 2019

(65) Prior Publication Data

US 2021/0148158 A1 May 20, 2021

(51) Int. Cl.

| | |
|---|---|
| ***E06B 1/34*** | (2006.01) |
| ***E06B 1/52*** | (2006.01) |
| *E06B 1/62* | (2006.01) |

(52) U.S. Cl.

CPC ..... *E06B 1/52* (2013.01); *E06B 1/34* (2013.01); *E06B 2001/622* (2013.01)

(58) Field of Classification Search

CPC ..... E06B 1/52; E06B 1/34; E06B 2001/622; E06B 1/526; E06B 1/18

See application file for complete search history.

(56) References Cited

U.S. PATENT DOCUMENTS

| | | | | | |
|---|---|---|---|---|---|
| 2,202,861 | A * | 6/1940 | Mills | E04B 2/7854 | 52/282.5 |
| 3,676,966 | A * | 7/1972 | Ragland | E06B 1/6023 | 52/211 |
| 3,783,559 | A * | 1/1974 | Yocum | E06B 1/18 | 49/504 |
| 3,906,671 | A * | 9/1975 | Maldonado | E06B 1/20 | 49/505 |
| 4,891,922 | A * | 1/1990 | Hozer | E04B 2/7422 | 160/135 |
| 4,936,065 | A * | 6/1990 | Hutchinson | E04B 2/96 | 52/235 |
| 5,353,571 | A * | 10/1994 | Berdan | B60R 13/04 | 24/293 |
| 5,642,593 | A * | 7/1997 | Shieh | E04B 2/7424 | 160/130 |

(Continued)

*Primary Examiner* — Brent W Herring
*Assistant Examiner* — Daniel J Kenny
(74) *Attorney, Agent, or Firm* — Bereskin & Parr LLP/S.E.N.C.R.L., s.r.l.

(57) ABSTRACT

A jamb assembly for a door frame includes an elongate jamb channel defining an interior space, an elongate cap member having a pair of spaced apart opposing in-turned portions, and a clip for securing the cap member to the jamb channel. The clip includes a base, a pair of opposed spaced apart resilient tabs extending from the base, and a pair of spaced apart retaining portions extending from the base, each retaining portion comprising a proximate resilient portion and a distal wing portion. When the base is located in the interior space, the tabs abut ridges that extend partially into the interior space, and the resilient portions are biased to engage the ridges. The resilient portions of the clip are configured to deform to allow the wing portions to pass between in-turned portions of the cap member and are biased to engage the in-turned portions.

14 Claims, 10 Drawing Sheets

(56) References Cited

U.S. PATENT DOCUMENTS

| | | | | |
|---|---|---|---|---|
| 6,173,937 | B1 * | 1/2001 | Cottongim | E04G 17/045 249/190 |
| 6,910,722 | B2 * | 6/2005 | Takeda | B60R 13/04 293/128 |
| 8,215,081 | B2 * | 7/2012 | Cummings | E04B 2/7422 52/745.05 |
| 10,731,400 | B2 * | 8/2020 | Bolduc | E06B 3/9642 |
| 10,871,024 | B2 * | 12/2020 | Carleton | E06B 1/36 |

* cited by examiner

JAMB ASSEMBLY FOR A DOOR FRAME

FIELD

This application relates generally to door frames, and more specifically to a jamb assembly for use in interior wall systems.

INTRODUCTION

Jamb assemblies are known. Such assemblies are commonly used to form a door frame for supporting a door that can be opened and closed to control entry into, for example, a room, an office, and the like.

Doors require alignment within their door frame for effective operation. In certain circumstances, a small misalignment can create operational issues. For example, the door latch may not align with the strike plate on the door frame. As a result, door frames in interior wall systems often require a significant degree of customization during assembly and/or installation. These customizations can involve trial and error and can lead to a diminished aesthetic appearance.

A wide variety of doors are available for use in interior wall system. (e.g. framed, frameless, glass, solid, etc.). Also, doors may vary in size based on the size of the door frame. In some cases, slight tolerances in the parts of the door frame assembly can create alignment issues.

In some cases, the door frame may not have consistent dimensions. For example, the jamb assembly might have been imperfectly installed or the floor to ceiling dimensions may vary. With existing jamb assemblies, it is not uncommon for frequent adjustments and/or interchange of components to be required to achieve an acceptable alignment with the door. With such a wide range of possible variation, the interchange of a substantial number of parts is often required for successful installation. These drawbacks are often compounded and can lead to a complex, inefficient, and/or costly installation process.

SUMMARY

This summary is intended to introduce the reader to the more detailed description that follows and not to limit or define any claimed or as yet unclaimed invention. One or more inventions may reside in any combination or subcombination of the elements or process steps disclosed in any part of this document including its claims and figures.

In accordance with a first broad aspect, there is provided a jamb assembly for a door frame, the jamb assembly comprising: an elongate jamb channel defining an interior space, wherein a pair of opposing spaced apart ridges extend partially into the interior space leaving a gap therebetween, wherein the ridges divide the interior space into an outer interior space and an inner interior space; an elongate cap member comprising a planar surface and a pair of spaced apart opposing in-turned portions, wherein the planar surface and the in-turned portions define a trough; a clip for securing the cap member to the jamb channel and to locate the cap member at least partially within the outer interior space, the clip comprising: a base; a pair of opposed spaced apart resilient tabs extending from the base; and a pair of spaced apart retaining portions extending from the base, each retaining portion comprising a proximate resilient portion and a distal wing portion, wherein each wing portion is turned-in in relation to the resilient portion; wherein, when the base is located in the inner interior space, the tabs abut the ridges and the resilient portions are biased to engage the ridges; wherein the resilient portions of the clip are configured to deform to allow the wing portions to pass between the in-turned portions of the cap member and locate in the trough, wherein the resilient portions are biased to engage the in-turned portions.

In some embodiments, the clip is releasably secured to the jamb channel.

In some embodiments, the cap member is releasably secured to the clip.

In some embodiments, the clip is configured to snap fit to the jamb channel, and the cap member is configured to snap fit to the clip.

In some embodiments, the tabs are configured to extend from the base in a direction away from the jamb channel when secured to the jamb channel.

In some embodiments, the resilient portions and the tabs are configured to extend in a generally similar direction away from the base.

In some embodiments, the jamb channel comprises a pair of opposing walls, each wall having a distal edge, wherein, when the cap member is secured to the jamb channel, the planar surface of the cap member is substantially flush with the distal edges of the walls.

In some embodiments, each in-turned portion of the cap member comprises a lip at a distal end thereof, the lip having an inclined surface, wherein, when the cap member is secured to the clip, the inclined surface of each lip is generally parallel to the adjacent resilient portion of the clip.

In some embodiments, the jamb assembly further comprises a plurality of the clips, wherein each clip secures the cap member to the jamb channel at a predetermined location along a length thereof.

In some embodiments, the jamb assembly further comprises at least two of the elongate cap members, at least two of the clips, and a strike plate assembly for receiving a door latch, wherein the strike plate assembly is configured to be located within the jamb channel at a predetermined location along a length thereof, wherein one of the at least two clips secures one of the two elongate cap members to the jamb channel above the strike plate assembly, and wherein the other of the at least two clips secures the other of the two elongate cap members to the jamb channel below the strike plate assembly.

In some embodiments, the one of the two elongate cap members substantially encloses the outer interior space of the jamb channel above the strike plate assembly and the other of the two elongate cap members substantially encloses the outer interior space of the jamb channel below the strike plate assembly.

In some embodiments, the strike plate assembly comprises: a main plate having a door-facing surface, an opposed surface opposite the door-facing surface, and an aperture defined therethrough; a sliding plate having a planar body and an elongate tab projecting generally perpendicularly from the body, wherein, when the tab is received in the aperture of the main plate, the tab and aperture collectively define a door latch-receiving cavity; and, at least one locking fastener configured to secure the sliding plate to the main plate in one of an unlocked configuration and a locked configuration, wherein, in the unlocked configuration, the body is slideable along the opposed surface of the main plate to adjust a position of the door latch-receiving cavity, and wherein, in the locked configuration, the body is fixed relative to the main plate.

In some embodiments, in the unlocked configuration, the sliding plate is actuated by sliding the tab.

In some embodiments, the main plate of the strike plate assembly is secured to jamb channel with at least one fastener.

In accordance with another broad aspect, there is provided a method of installing a pivot door within an interior wall system and above a floor surface, the method comprising: assembling a door frame comprising a first vertical door jamb channel, a second vertical door jamb channel, and a horizontal door jamb channel extending between the first and second vertical door jamb channels, wherein the first vertical door jamb channel defines a first interior space, and the second vertical door jamb channel defines a second interior space, wherein the first interior space faces the second interior space, mounting a lower pivot assembly to the first vertical door jamb channel proximate a juncture of a lower end of the first vertical door jamb channel and the floor surface; mounting an upper pivot assembly to the horizontal door jamb channel proximate a juncture of an upper end of the first vertical door jamb channel and the horizontal door jamb channel; securing the pivot door to the lower pivot assembly and to the upper pivot assembly, such that the pivot door is pivotable between a closed position and an open position; determining a location for a door latch of the pivot door relative to the second vertical door jamb channel; securing a strike plate at least partially within the second interior space of the second vertical door jamb channel based on the location, wherein the strike plate divides the second interior space into an upper interior space and a lower interior space; securing an upper cap member at least partially within the upper interior space of the second vertical door jamb channel using at least one clip, wherein the at least one clip engages both the upper cap member and the second vertical door jamb channel, wherein the at least one clip is positioned entirely between the upper cap member and the second vertical door jamb channel, wherein the upper cap member extends between the strike plate and the horizontal door jamb channel.

In some embodiments, the method further comprises securing a lower cap member at least partially within the lower interior space of the second vertical door jamb channel using another at least one clip, wherein the other at least one clip engages both the lower cap member and the second vertical jamb channel, wherein the other at least one clip is positioned entirely between the lower cap member and the second vertical jamb channel, wherein the lower cap member extends between the strike plate and the floor surface.

In some embodiments, the method further comprises cutting a single cap member extrusion to form both the upper cap member and the lower cap member.

In some embodiments, the method further comprises securing a pivot-side cap member at least partially within the first interior space of the first vertical door jamb channel using at least two clips, wherein each of the at least two clips engage both the pivot-side cap member and the first vertical jamb channel, wherein the at least two clips are positioned entirely between the pivot-side cap member and the first vertical jamb channel, wherein the pivot-side cap member extends between the horizontal door jamb channel and the lower pivot assembly.

In some embodiments, each of the first and second vertical door jamb channels have a transverse cross-section, wherein the transverse cross-section of the first vertical door jamb channel is substantially a mirror image of the transverse cross-section of the second vertical door jamb channel.

In some embodiments, each of the at least one clip, the another at least one clip, and the at least two clips have a common design.

It will be appreciated by a person skilled in the art that a method or apparatus disclosed herein may embody any one or more of the features contained herein and that the features may be used in any particular combination or sub-combination.

These and other aspects and features of various embodiments will be described in greater detail below.

BRIEF DESCRIPTION OF THE DRAWINGS

For a better understanding of the described embodiments and to show more clearly how they may be carried into effect, reference will now be made, by way of example, to the accompanying drawings in which.

Figure 1:
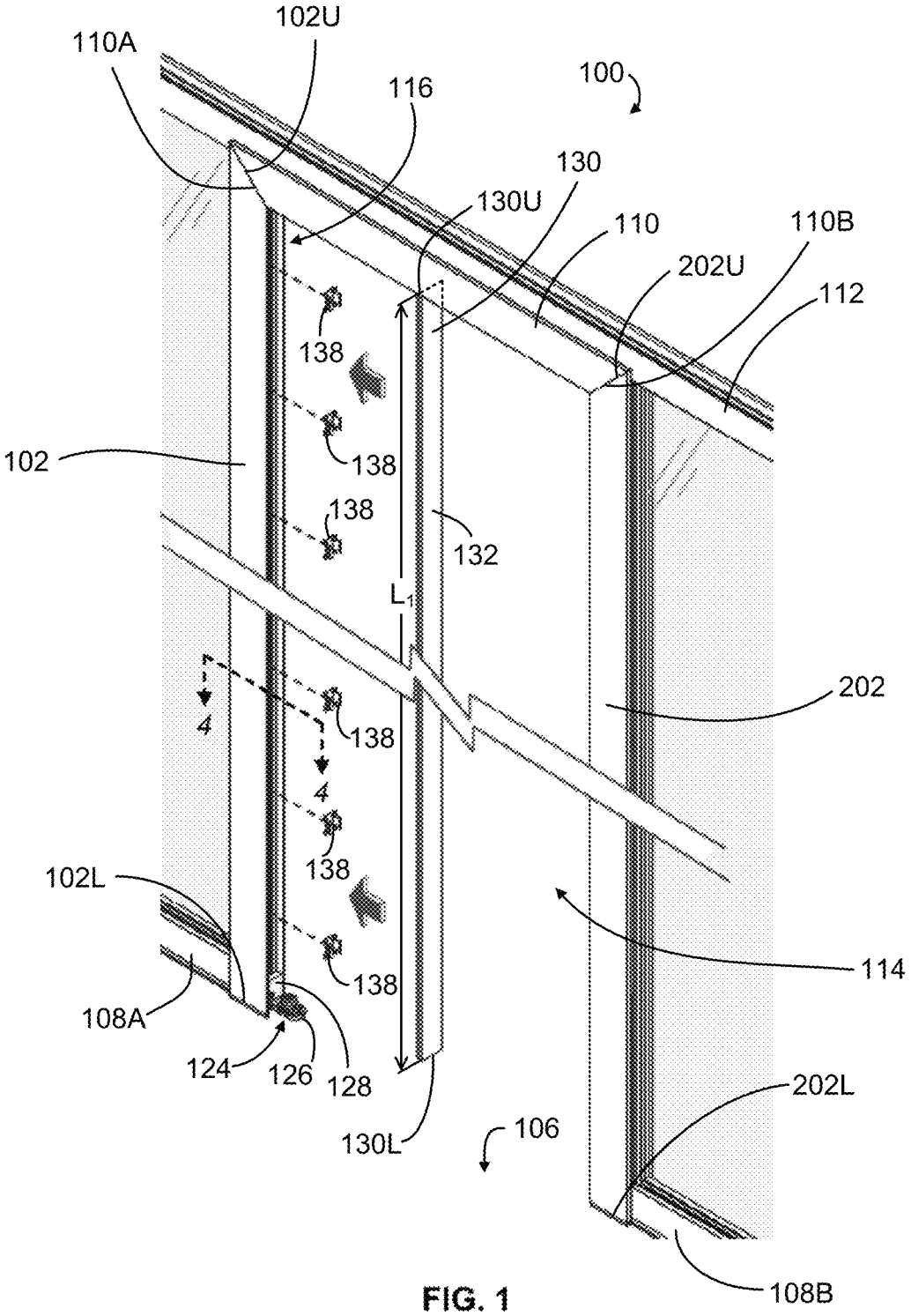
FIG. 1 is a partially exploded perspective view of a door frame within an interior wall system formed using an exemplary jamb assembly.

The drawings included herewith are for illustrating various examples of articles, methods, and apparatuses of the teaching of the present specification and are not intended to limit the scope of what is taught in any way.

DETAILED DESCRIPTION

Various apparatuses, methods and compositions are described below to provide an example of an embodiment of each claimed invention. No embodiment described below limits any claimed invention and any claimed invention may cover apparatuses and methods that differ from those described below. The claimed inventions are not limited to apparatuses, methods and compositions having all of the features of any one apparatus, method or composition described below or to features common to multiple or all of the apparatuses, methods or compositions described below. It is possible that an apparatus, method or composition described below is not an embodiment of any claimed invention. Any invention disclosed in an apparatus, method or composition described below that is not claimed in this document may be the subject matter of another protective instrument, for example, a continuing patent application, and the applicant(s), inventor(s) and/or owner(s) do not intend to abandon, disclaim, or dedicate to the public any such invention by its disclosure in this document.

Furthermore, it will be appreciated that for simplicity and clarity of illustration, where considered appropriate, reference numerals may be repeated among the figures to indicate corresponding or analogous elements. In addition, numerous specific details are set forth in order to provide a thorough understanding of the example embodiments described herein. However, it will be understood by those of ordinary skill in the art that the example embodiments described herein may be practiced without these specific details. In other instances, well-known methods, procedures, and components have not been described in detail so as not to obscure the example embodiments described herein. Also, the description is not to be considered as limiting the scope of the example embodiments described herein.

The terms "an embodiment," "embodiment," "embodiments," "the embodiment", "the embodiments", "one or more embodiments", "some embodiments", and "one embodiment" mean "one or more (but not all) embodiments of the present invention(s)", unless expressly specified otherwise.

The terms "including", "comprising", and variations thereof mean "including but not limited to", unless expressly specified otherwise. A listing of items does not imply that any or all of the items are mutually exclusive, unless expressly specified otherwise. The terms "a", "an", and "the" mean "one or more", unless expressly specified otherwise.

The use of the words "vertical" or "horizontal" are used herein to indicate orientation of elements once installed, and are therefore not intended to be used in a limiting way.

FIG. 1 illustrates an exemplary jamb assembly, referred to generally as 100. Jamb assembly 100 may be used to form a door frame, or part of a door frame, that supports a door. A supported door can be opened and closed to control entry into, for example, a room, an office, and the like. In the illustrated example, the jamb assembly 100 forms a door frame in an interior wall system. Interior wall systems are commonly used to finish office open areas in office buildings. As will be described in detail below, the jamb assembly 100 can accommodate for tolerance in parts, variations in floor to ceiling dimension, and other inconsistencies that may otherwise cause alignment issues and/or necessitate the interchange of parts.

In the illustrated example, jamb assembly 100 includes a first elongate jamb channel (e.g. first vertical jamb channel 102) and a second elongate jamb channel (e.g. second vertical jamb channel 202) spaced from and facing the first jamb channel 102. The first jamb channel 102 extends longitudinally from a lower end 102L to an upper end 102U. Similarly, the second jamb channel 202 extends longitudinally from a lower end 202L to an upper end 202U.

The lower end 102L of the first jamb channel 102 and the lower end 104L of the second jamb channel 104 are supported on or above a floor surface 106. The lower ends 102L and 104L may be secured to the floor surface 106 to improve stability of the jamb assembly 100. In the illustrated example, to further improve the stability of the jamb assembly 100, the lower ends 102L and 202L of the first and second jamb channels 102 and 202 are respectively secured to floor brackets 108A and 108B of the interior wall system.

In the illustrated example, the jamb assembly 100 also includes a third elongate jamb channel 110 that extends horizontally between the upper ends 102U and 202U of the first and second jamb channels 102 and 202. The third jamb channel 110 extends longitudinally from a first end 110A to second end 1106. In the illustrated example, the third jamb channel 110 is secured to a ceiling bracket 112 of the interior wall system to improve stability of the jamb assembly 100.

To further improve the stability of the jamb assembly 100, the first end 110A of the third jamb channel 110 may be secured to the upper end 102U of the first jamb channel 102 and/or the second end 1106 of the third jamb channel 110 may be secured to the upper end 202U of the second jamb channel 202. The third jamb channel 110 may be secured to either of the first and second jamb channel 102 and 202 in a number of suitable ways, using e.g. mechanical fasteners, adhesives, press fits, or a combination thereof. In the illustrated example, the first end 110A of the third jamb channel 110 and the upper end 102U of the first jamb channel 102 are cut and secured to each other at complimentary angles. Similarly, the second end 1106 of the third jamb channel 110 and the upper end 202U of the second jamb channel 202 are cut and secured at complimentary angles.

Figure 9:
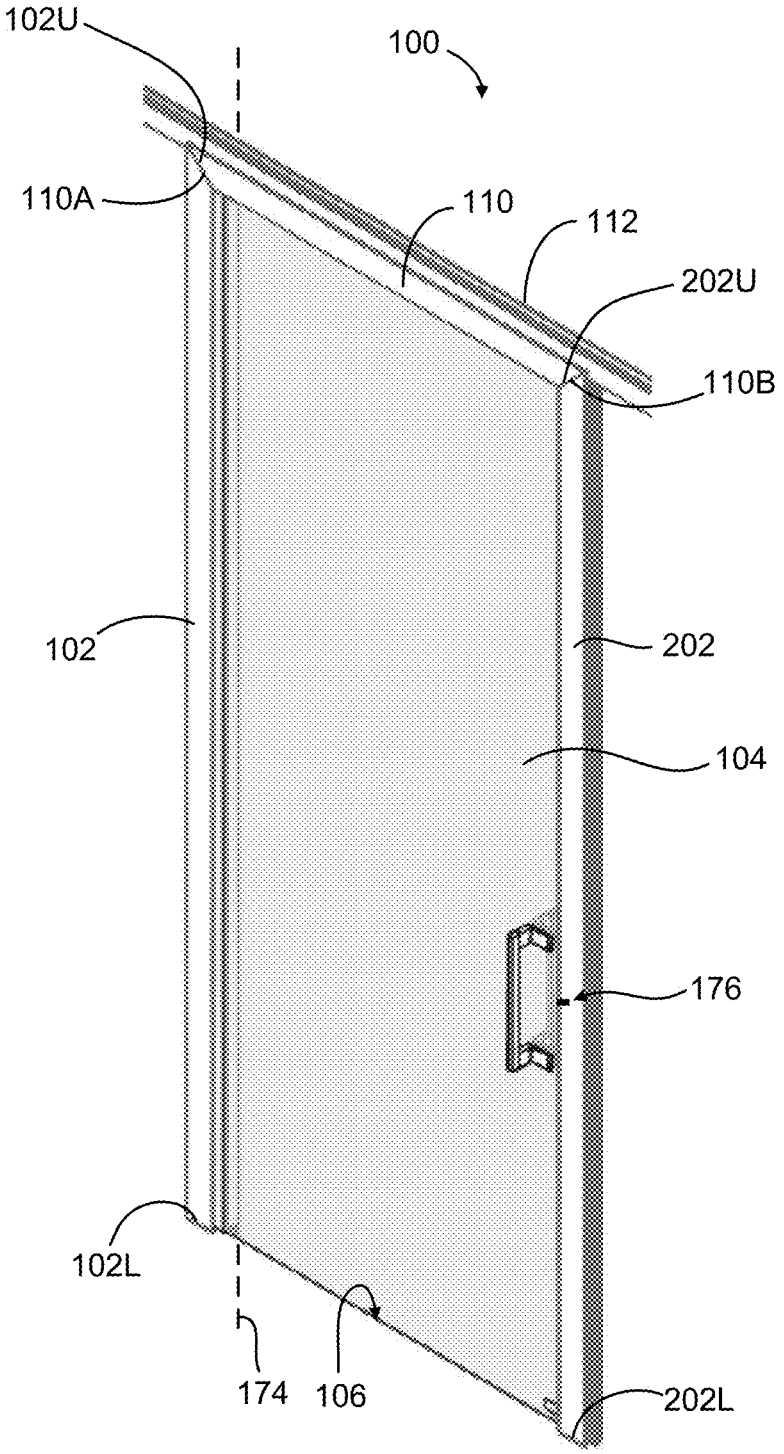
FIG. 9 is a perspective view of the door frame and pivot door of FIG. 8, with the pivot door in a closed position.

With continued reference to FIG. 1, the jamb assembly 100 and the floor surface 106 define an opening 114 bounded by the first and second jamb channels 102 and 202 on opposite sides, the third jamb channel 110 on the top, and the floor surface 106 on the bottom. Turning to FIG. 9, a pivot door 104 is preferably dimensioned slightly smaller than the opening 114 so that the pivot door 104 may be supported by the jamb assembly 100 within the opening 114.

Figure 4:
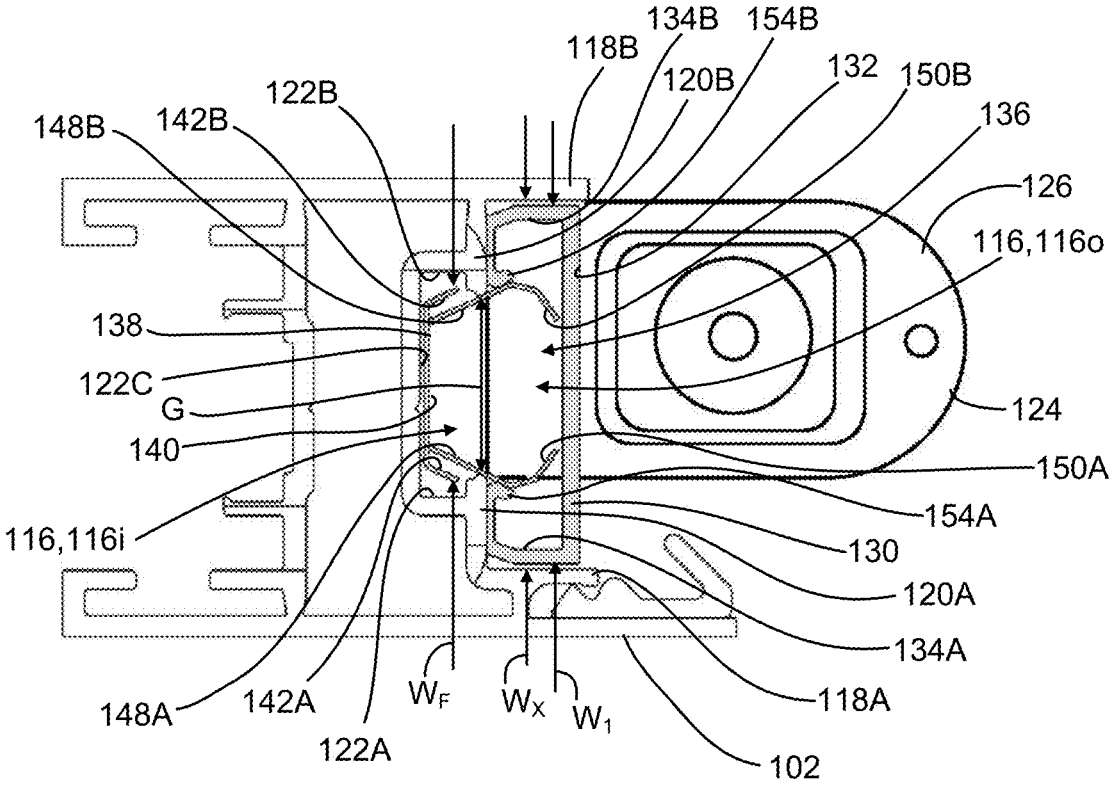
FIG. 4 is a section view taken along line 4-4 of FIG. 1 showing a cap member secured to a first vertical jamb channel of the jamb assembly.

With reference to FIGS. 1 and 4, the first jamb channel 102 defines an elongate interior space 116 that extends between the upper and lower ends 102U and 102L of the first jamb channel 102. As shown in FIG. 4, the first jamb channel 102 includes a pair of opposing walls 118A and 1186 that partially bound the interior space 116. The first jamb channel 102 also includes a pair of opposing and spaced apart ridges 120A and 1206 that extend partially into the interior space 116 from corresponding walls 118A and 118B. The first jamb channel 102 also includes a pair of opposing and spaced apart sidewalls 122A and 1226 that extend generally perpendicularly from corresponding ridges 120A and 120B and a base wall 122C that extends between the sidewalls 122A and 122B at distal edges thereof. The ridges 120A and 120B leave a gap G therebetween. The ridges 120A and 120B divide the interior space 116 into an outer interior space 116*o* and an inner interior space 116*i* bounded by sidewall 122A, base wall 122C, and sidewall 122B.

Figure 2:
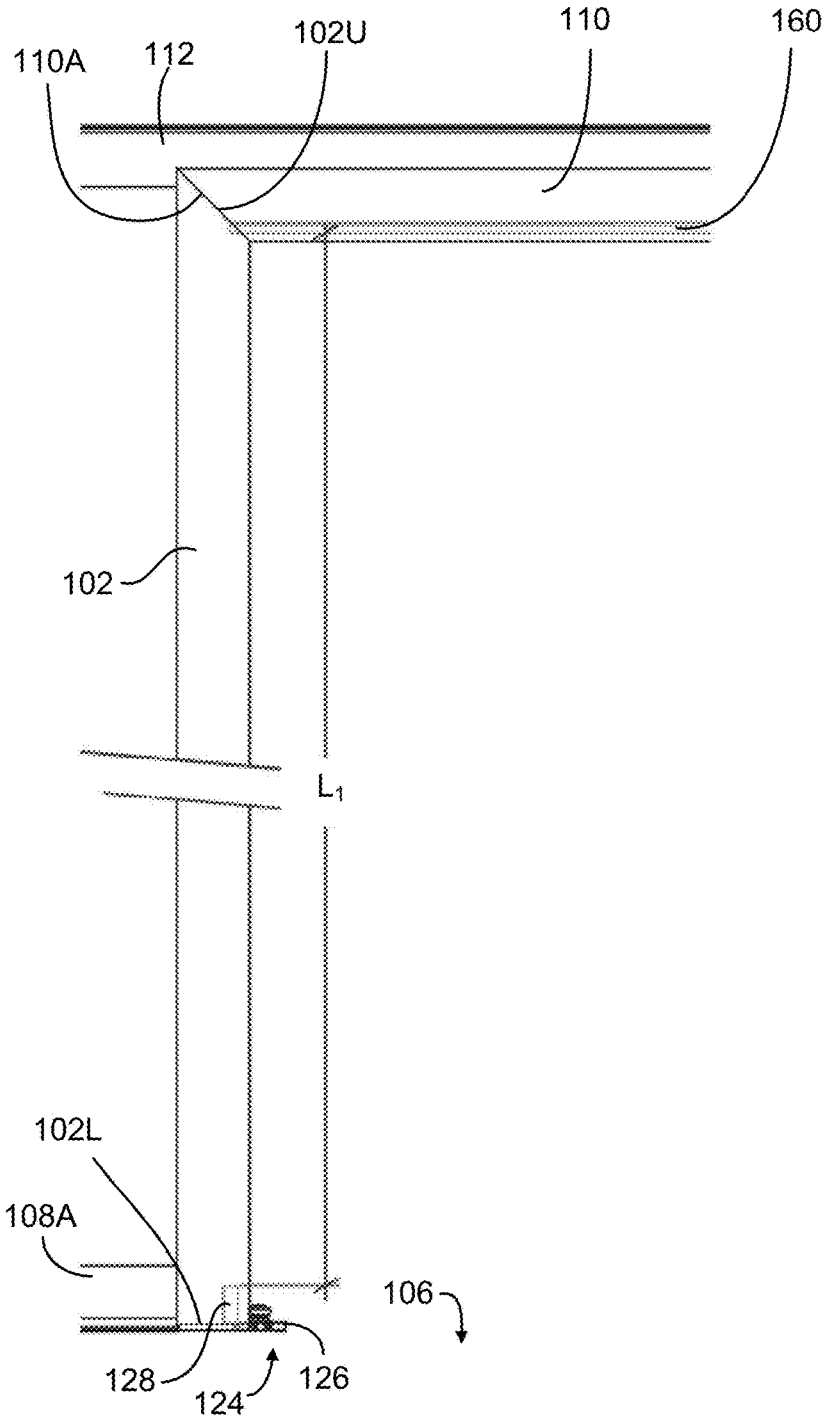
FIG. 2 is a partial elevation view of one side of the door frame of FIG. 1.

As shown in FIGS. 1, 2, and 4, a lower pivot assembly 124 may be used to support a lower end of a pivot door (e.g. pivot door 104 in FIG. 9) above floor surface 106. In addition to bearing the weight of the pivot door, the lower pivot assembly 124 may act as a lower pivot point for the pivot door. In the illustrated example, the lower pivot assembly 124 includes a base 126 and a plate 128 that extends generally perpendicularly from the base 126. In the illustrated example, the lower pivot assembly 124 is generally L-shaped.

As shown in FIG. 4, the plate 124 substantially fits within the outer interior space 116*o* of first jamb channel 102 and the base 126 rests on the floor surface 106. The plate 128 of lower pivot assembly 124 may be secured to the first jamb channel 102, e.g. by a mechanical fastener or the like. Alternatively, or additionally, the base 126 of lower pivot assembly 124 may be secured to the floor surface 106, e.g. using a mechanical fastener and/or an adhesive.

Referring again to FIG. 1, an elongate cap member 130 is shown longitudinally aligned with the first jamb channel 102. In this arrangement, the cap member 130 may be received in the interior space 116 of first jamb channel 102. As will be described in greater detail below, the cap member 130 may be secured to the first jamb channel 102 to prevent it from disengaging the interior space 116.

With reference to FIGS. 1 and 4, the cap member 130 includes a planar surface 132 and a pair of spaced apart and opposing in-turned portions 134A and 134B. In the illustrated example, the in-turned portions 134A and 134B extend from planar surface 132 along opposite edges thereof. As best shown in FIG. 4, the planar surface 132 and the in-turned portions 134A and 134B define a trough 136.

In the illustrated example, the cap member 130 has a length $L_1$ measured between an upper end 130U and a lower end 130L thereof. As will be described in more detail below, the length $L_1$ of cap member 130 member may be dimensioned so that it substantially encloses the interior space 116. In the illustrated example, the cap member 130 is sized to substantially enclose the interior space 116 between the third jamb channel 110 and the lower pivot assembly 124. For example, the cap member 130 may extend to an upper end of plate 128, or to an upper end of base 126.

In one or more alternative embodiments (not shown), the lower pivot assembly 124 may not have a plate 128. Without a plate 128, the lower pivot assembly 124 may be secured directly to the floor surface 106, e.g. by a fastener passing through the base 126. In such alternative embodiments, the base 126 of lower pivot assembly 124 may not extend into the interior space 116 of first jamb channel 102 and the cap member 130 may extend to the floor surface 106.

Referring to FIG. 2, the length $L_1$ represents a cap length required to substantially enclose the interior space 116. The length $L_1$ of cap member 130 may be determined by e.g. measuring the length between the horizontal cap 110 and the top end of plate 128.

Figure 3:
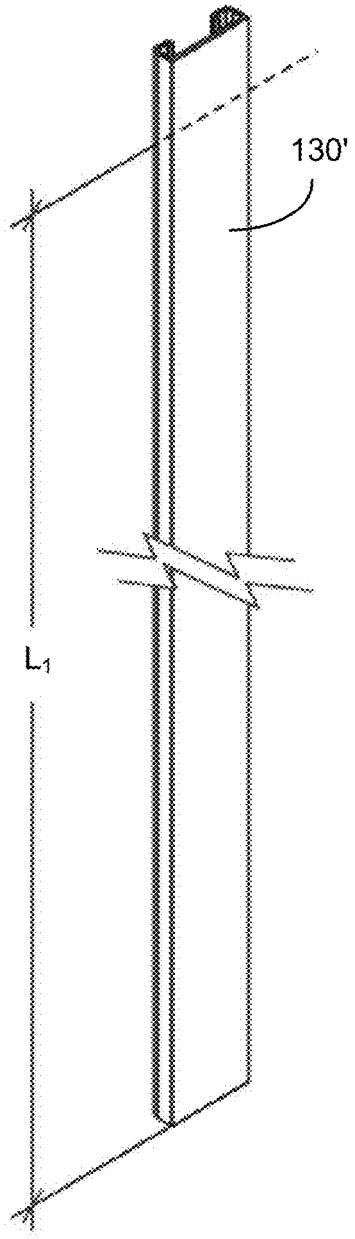
FIG. 3 is a perspective view of an exemplary cap member extrusion.

Referring to FIG. 3, a cap member extrusion 130' may be cut to the length $L_1$ to provide cap member 130. In this context, the cap member extrusion 130' may be one of many standardized caps stored in an inventory and/or warehouse available to an installer. Those skilled in the art will appreciate that the cap member extrusion 130' selected by the installer preferably has a length equal to or longer than length $L_1$. In the illustrated example, the cap member extrusion 130' has a length that is longer than that required to substantially enclose the interior space 116 (i.e. longer than length $L_1$), and may be cut to length to provide cap member 130 (e.g. with length $L_1$).

It will be appreciated that the cap member extrusion 130' may be cut to length $L_1$ on-site. For example, an installer may bring one or more cap member extrusions 130' with varying dimensions to an installation site. The installer may then select a desired cap member extrusion 130' (e.g. after measuring a jamb channel to determine a length $L_1$) and cut it to provide a cap member 130 with length $L_1$. Alternatively, a cap member extrusion 130' may be cut off-site to provide cap member 130 with length $L_1$.

In the illustrated example, clips 138 are used to secure to the cap member 130 to the first jamb channel 102 and to locate the cap member 130 at least partially within the outer interior space 116*o*. Each clip 138 is positionable along the first jamb channel 102 within the interior space 116. As will be described in more detail below, the clips 138 maintain engagement between the cap member 130 and the first jamb channel 102. In the illustrated example, the clips 138 are spaced at a consistent interval. Alternatively, clips 138 may be positioned at any suitable interval along the jamb channel.

The number of clips 138 used to secure the cap member 130 to the first jamb channel 102 may vary. It will be appreciated that the number of clips 138 may vary depending on the length $L_1$ of cap member 130. Preferably, at least one clip 138 is positioned proximate the lower end 102L of the first jamb channel 102 and at least one clip 138 is positioned proximate the upper end 102U of the first jamb channel 102. In general, increasing the number of clips 138 may strengthen the engagement between the cap member 130 and the first jamb channel 102.

Figure 5:
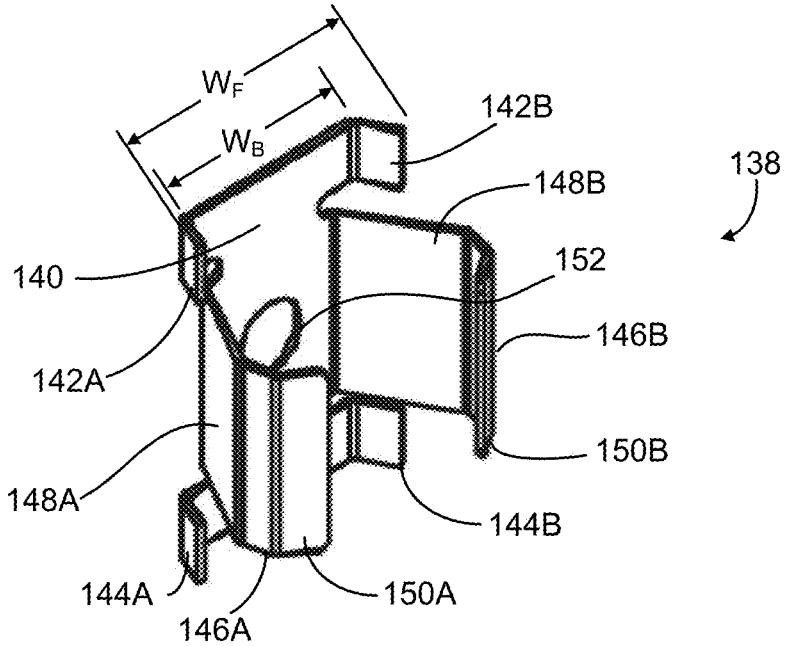
FIG. 5 is a perspective view of an exemplary clip for securing a cap member to a jamb channel.

Turning to FIG. 5, the clip 138 includes a base 140, and a first pair of opposed and spaced apart resilient tabs 142A and 142B and a second pair of opposed and spaced apart resilient tabs 144A and 144B. The first pair of tabs 142A, 142B and the second pair of tabs 144A, 144B extend outwardly from the base 140 at opposite end thereof. Tabs 142A and 142B extend away from each other. Similarly, tabs 144A and 144B extend away from each other. The base 140 has a width $W_B$ between proximal ends of opposing tabs (e.g. between proximal ends of tabs 142A and 142B as shown). Base 140 also has a width $W_F$ between distal ends of opposing tabs (e.g. between distal ends of tabs 142A and 142B as shown). Since tabs 142A and 142B extend away from each other, width $W_F$ is greater than width $W_B$. It will be appreciated that in one or more alternative embodiments, the tabs may have other configurations. For example, only one pair of tabs may be provided.

With continued reference to FIG. 5, the clip 138 also includes a pair of spaced apart retaining portions 146A and 146B that extend from the base 140. In the illustrated example, retaining portion 146A extends from the base 140 between tabs 142A and 144A, while retaining portion 146B extends from the base 140 between tabs 142B and 144B.

Each retaining portion 146A, 146B includes a proximate resilient portion 148A, 148B extending from the base 140 and a distal wing portion 150A, 150B extending from corresponding resilient portions 148A, 148B. The resilient portions 148A and 148B extend away from each other. Preferably, as shown, resilient portion 148A extends in generally the same direction as tabs 142A and 144A while the resilient portion 148B extends in generally the same direction as tabs 142B and 144B.

Referring still to FIG. 5, each wing portion 150A, 150B is turned-in in relation to its corresponding resilient portion 148A, 148B such that the wing portions 150A and 150B extend toward each other. The resilient portions 148A and 148B may resiliently deform about the base 140 when a pressure is applied to the clip 138 that presses the resilient portions 148A and 1486 toward each other.

Referring again to FIG. 4, gap G between the ridges 120A and 120B of first jamb channel 102 is preferably slightly smaller than width $W_F$ of clip 138. In this way, when the base 140 of the clip 138 is located in the inner interior space 116*i*, tabs 142A and 142B abut corresponding ridges 120A and 120B. (While not visible in FIG. 4, tabs 144A and 144B also abut corresponding ridges 120A and 120B). Therefore, the first and second pair of tabs 142A, 142B and 144A, 144B inhibit or prevent the clip 138 from disengaging from the first jamb channel 102. For example, if the clip 138 is subjected to a force that pulls it away from the interior space 116, the tabs 142A-144B may catch or otherwise engage corresponding ridges 120A and 120B to prevent the base 140 from popping out of the inner interior space 116*i*.

In the illustrated example, the clip 138 may be snap fit to the first jamb channel 102 by pressing the base 140 of the clip 138 into the inner interior space 116*i*. As the base 140 is pressed into the inner interior space 116*i*, opposing tabs in the first and second pair of tabs resiliently deform to allow the base 140 to pass through gap G (e.g. at least one of tabs 142A and 142B may deform slightly toward each other, and at least one of tabs 144A and 144B may deform slightly toward each other).

With continued reference to FIG. 4, when the base 140 of the clip 138 is located in the inner interior space 116*i*, the resilient portions 148A and 1486 engage corresponding ridges 120A and 120B. In such a configuration, the resilient portions 148A and 148B are biased outwardly and exert a holding force against corresponding ridges 120A and 120B. This holding force acts to hold the clip 138 in a predetermined location along the first jamb channel 102. To reposition the clip 138, the first and second resilient portions 148A and 148B may be further deformed, e.g. by pinching the resilient portions 148A and 148B with a thumb and forefinger towards each other, to lessen or release the holding force exerted on corresponding ridges 120A and 120B.

Optionally, once the clip 138 is located as desired, it may be secured to the first jamb channel 102 to limit undesired movement (i.e. translation up and down the first jamb channel 102). For example, the clip 138 may be secured with a fastener (not shown) that passes through an aperture 152 defined in the base 140 to engage the base wall 122C of first jamb channel 102. Alternatively, or in addition, an adhesive (e.g. tape or glue) may be placed between the base 140 of clip 138 and the base wall 122C of first jamb channel 102.

Referring still to FIG. 4, when the base 140 of the clip 138 is located in the inner interior space 116*i*, resilient portions 148A and 148B project through gap G and into the outer interior space 116*o*. In this arrangement, the resilient portions 148A and 1486 may respectively engage the in-turned portions 134A and 1346 of cap member 130.

In the illustrated example, the cap member 130 may be snap fit to the clips 138 by pressing the cap member 130 into the outer interior space 116*o* with the trough 136 facing the outer interior space 116*o*, e.g. as shown in FIG. 1. As the cap member 130 is pressed into the outer interior space 116*o*, the resilient portions 148A and 148B resiliently deform toward each other to allow corresponding wing portions 150A and 150B to pass between the in-turned portions 134A and 134B of the cap member 130 and locate in the trough 136. In such a configuration, the resilient portions 148A and 148B exert a holding force against corresponding in-turned portion 134A and 134B of the cap member 130. This holding force acts to retain the wings portions 150A and 150B in the trough 136, thereby securing the cap member 130 to the first jamb channel 102.

Alternatively, the clip 138 may be engaged first with cap member 130 by pressing the wing portions 150*a* and 150*b* into the trough 136. The clip 138 may then subsequently be engaged with first jamb channel 102 by pressing the cap member 130 (and thus base 140) into the inner interior space 116*i*.

With continued reference to FIG. 4, each in-turned portion 134A and 134B of the cap member 130 comprises a lip 154A and 154B at a distal end thereof. The lips 154A and 154B each have an inclined or beveled surface. As shown, when the cap member 130 is secured to the clip 138, the inclined surface of each lip 154A and 154B is generally parallel to the adjacent resilient portion 148A and 1486 of the clip 138. This may promote improved engagement between the clip 138 and the cap member 130.

Although cap member 130 is secured to the first jamb channel 102 using clips 138 in the illustrated example, it will be appreciated that the cap member 130 may additionally or alternatively be secured to jamb channel 102 by other means, e.g. using mechanical fasteners, adhesives, and the like.

When the cap member 130 is secured to the first jamb channel 102, e.g. as described above, the cap member 130 is at least partially located within the outer interior space 116*o*. In the illustrated example, when the cap member 130 is secured to the first jamb channel 102, the planar surface 132 of cap member 130 is slightly set in from distal edges of opposing walls 118A and 118B. In this arrangement, the cap member 130 does not protrude from first jamb channel 102 and is fully located within the outer interior space 116*o*. In one or more alternative embodiments (not shown), the planar surface 132 of the cap member 130 may be substantially flush with the distal edges of opposing walls 118A and 1186. This arrangement may provide the first jamb channel 102 with a smoother visual appearance. In one or more alternative embodiments (not shown), the planar surface 132 of the cap member 130 may be slightly raised from the distal edges of opposing walls 118A and 118B.

With continued reference to FIG. 4, in the illustrated example the cap member 130 has a width $W_1$ that is slightly smaller than a width $W_X$ of outer interior space 116*o* (measured from wall 118A to wall 118B of first jamb channel 102). Therefore, when the cap member 130 is secured to the first jamb channel 102, the width $W_1$ and the length $L_1$ of cap member 130 are dimensioned to substantially enclose the interior space 116. In one or more alternative embodiments, width $W_1$ may be noticeably smaller than width $W_X$, e.g. to provide a different aesthetic.

Figure 6:
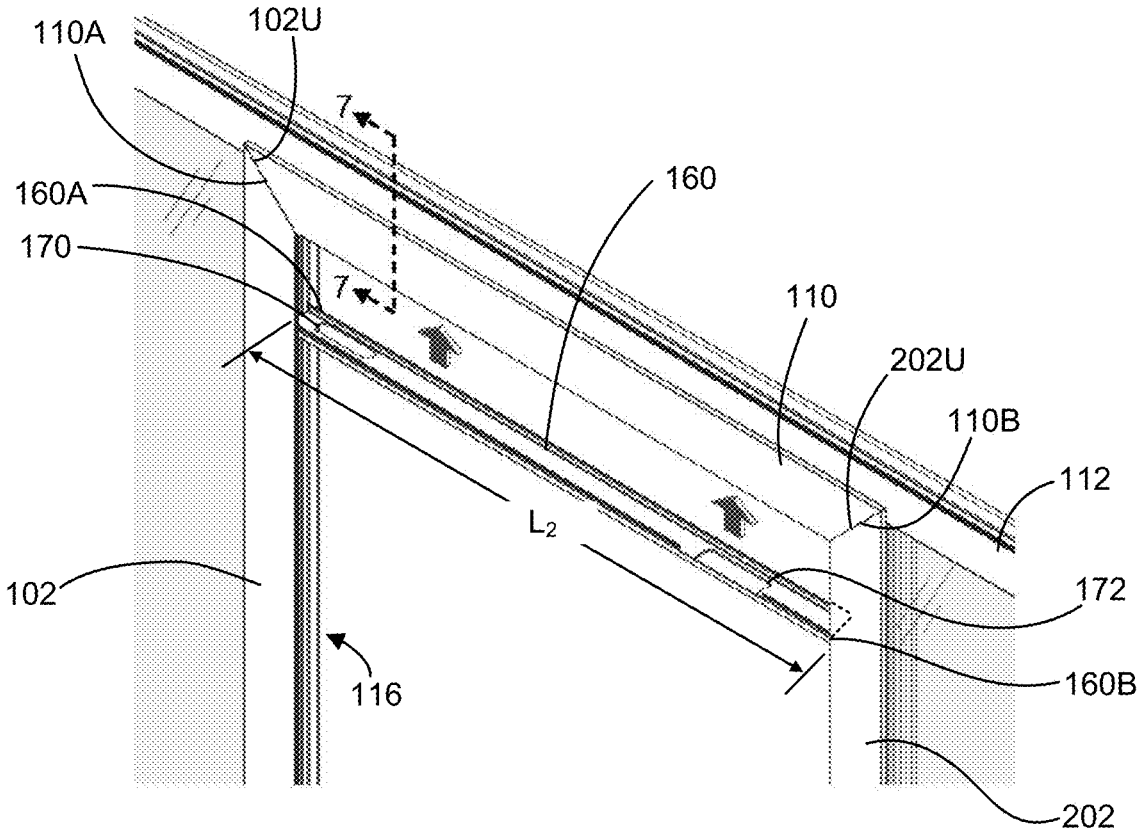
FIG. 6 is a perspective view of an upper portion of the door frame of FIG. 1.
Figure 7:
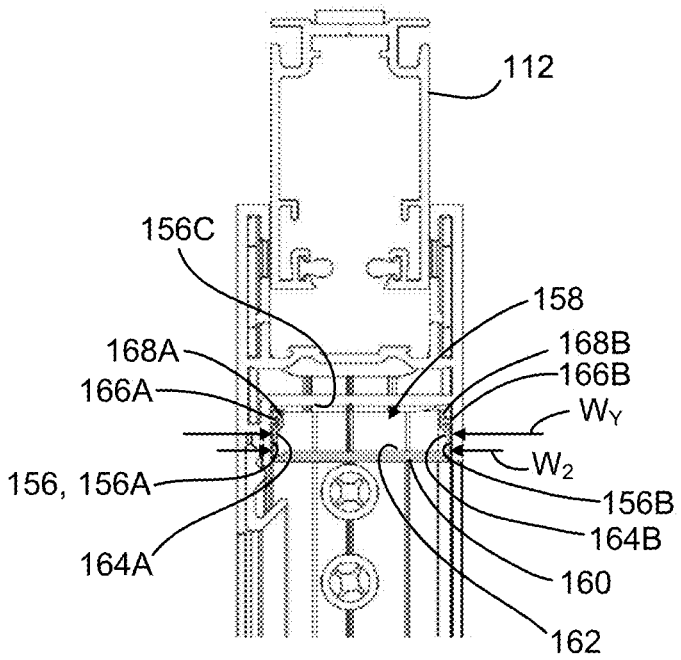
FIG. 7 is a section view taken along line 7-7 of FIG. 6 showing a cap member secured to a horizontal jamb channel.

Turning to FIGS. 6 and 7, the third jamb channel 110 has a recessed portion 156 that extends longitudinally between the first and second ends 110A and 1106. As shown in FIG. 6, the third jamb channel 110 is secured to the ceiling bracket 112 with the recessed portion 156 facing down (i.e. toward floor surface 106). The recessed portion 156 includes a top wall 156C and first and second sidewalls 156A and 156B that extend generally perpendicularly from opposite edges of the top wall 156C. Sidewall 156A, top wall 156C, and sidewall 156B of recessed portion 156 define a generally rectangular interior space 158.

Referring to FIG. 6, an elongate cap member 160 is shown longitudinally aligned with the third jamb channel 110. In this arrangement, the cap member 160 may be received in the interior space 158 of third jamb channel 110. As will be described in more detail below, the cap member 160 may be secured to the third jamb channel 110 to prevent it from disengaging the interior space 158.

As best shown in FIG. 7, the cap member 160 includes a generally planar surface 162 and a pair of spaced apart and opposing in-turned portions 164A and 164B. In the illustrated example, the in-turned portions 164A and 164B extend from planar surface 162 along opposite edges thereof.

The cap member 160 has a length $L_2$ between a first end 160A and a second end 160B thereof. Length $L_2$ of cap member 160 may be selected so that it substantially encloses the interior space 158 of the third jamb channel 110. In the illustrated example, length $L_2$ substantially corresponds to a length measured between the first and second ends 110A and 1106 of the third jamb channel 110. In this way, when the cap member 160 is secured to the third jamb channel 110, the interior space 158 is substantially enclosed.

Additionally, as shown in FIG. 7, the cap member 160 has a width $W_2$ that slightly smaller than a width $W_Y$ of interior space 158 (measured from first sidewall 156B to second sidewall 156C of third jamb channel 110). Therefore, when the cap member 160 is secured to the third jamb channel 110, the width $W_2$ and the length $L_2$ of cap member 160 are dimensioned to substantially enclose the interior space 158. In one or more alternative embodiments, width $W_2$ may be noticeably smaller than width $W_Y$, e.g. to provide a different aesthetic.

Cap member 160 may be one of many standardized caps stored in an inventory and/or warehouse available to an installer. In some cases, the cap member 160 that is selected by the installer may have a length generally equal to the length measured between the first and second ends 110A and 1106 of the horizontal jamb 110 (i.e. already having length $L_2$). For example, after measuring or being provided this length, the installer can select the appropriately sized cap member 160 from inventory. In other cases, a longer cap member (not shown) may be cut to the length $L_2$ on or off site to provide the cap member 160.

Referring to FIG. 7, third jamb channel 110 includes a pair of tabs 166A and 166B that extend into the interior space 158 from the first and second sidewalls 156A and 156B, respectively. Each in-turned portion 164A, 164B of cap member 160 has a notch 168A, 168B located proximate a distal end thereof. In the illustrated example, cap member 160 may be snap fit to the third jamb channel 110 by pressing the cap member 160 upwardly into the interior space 158 with in-turned portions 164A and 164B facing the interior space 158, e.g. as shown in FIG. 6. As the cap member 160 is pressed into the interior space 158, the notches 168A and 168B snap with corresponding tabs 166A and 166B. In one or more alternative embodiments (not shown), the cap member 160 may be secured to the third jamb channel 110 in other suitable ways, e.g. using mechanical fasteners, an adhesive, or the like. Alternatively, or additionally, a clip (e.g. similar to clip 138 shown on FIG. 5) may be used to secure the cap member 160 to the third jamb channel 110.

Referring to FIG. 7, when the cap member 160 is secured to the third jamb channel 110, e.g. as described above, the cap member 160 is at least partially located within the interior space 158. In the illustrated example, when the cap member 160 is secured to the third jamb channel 110, the planar surface 162 of cap member 160 is substantially flush with distal edges of sidewalls 156A and 1566. In this arrangement, the cap member 160 does not protrude from third jamb channel 110 and is fully located within the interior space 158. This arrangement may also provide the third jamb channel 110 with a smooth and aesthetically pleasing appearance. It will be appreciated that, in one or more alternative embodiments, the planar surface 162 of cap member 160 may be recessed from, or raised from, distal edges of sidewalls 156A and 156B.

Referring again to FIG. 6, the cap member 160 has first and second apertures 170 and 172 defined through planar surface 162. An upper pivot assembly (not shown) may be received within the first aperture 170. The upper pivot assembly may be used to support an upper end of a pivot door and/or function as an upper pivot point for the pivot door. In cases where the pivot door is frameless, a strike plate assembly (not shown) may be received within the second aperture 172.

In the illustrated example, cap member 160 is secured to the third jamb channel 110 before cap member 130 is secured to the first jamb channel 102. However, in one or more alternative embodiments, cap member 130 may be secured to the first jamb channel 102 before cap member 160 is secured to the third jamb channel 110.

Figure 8:
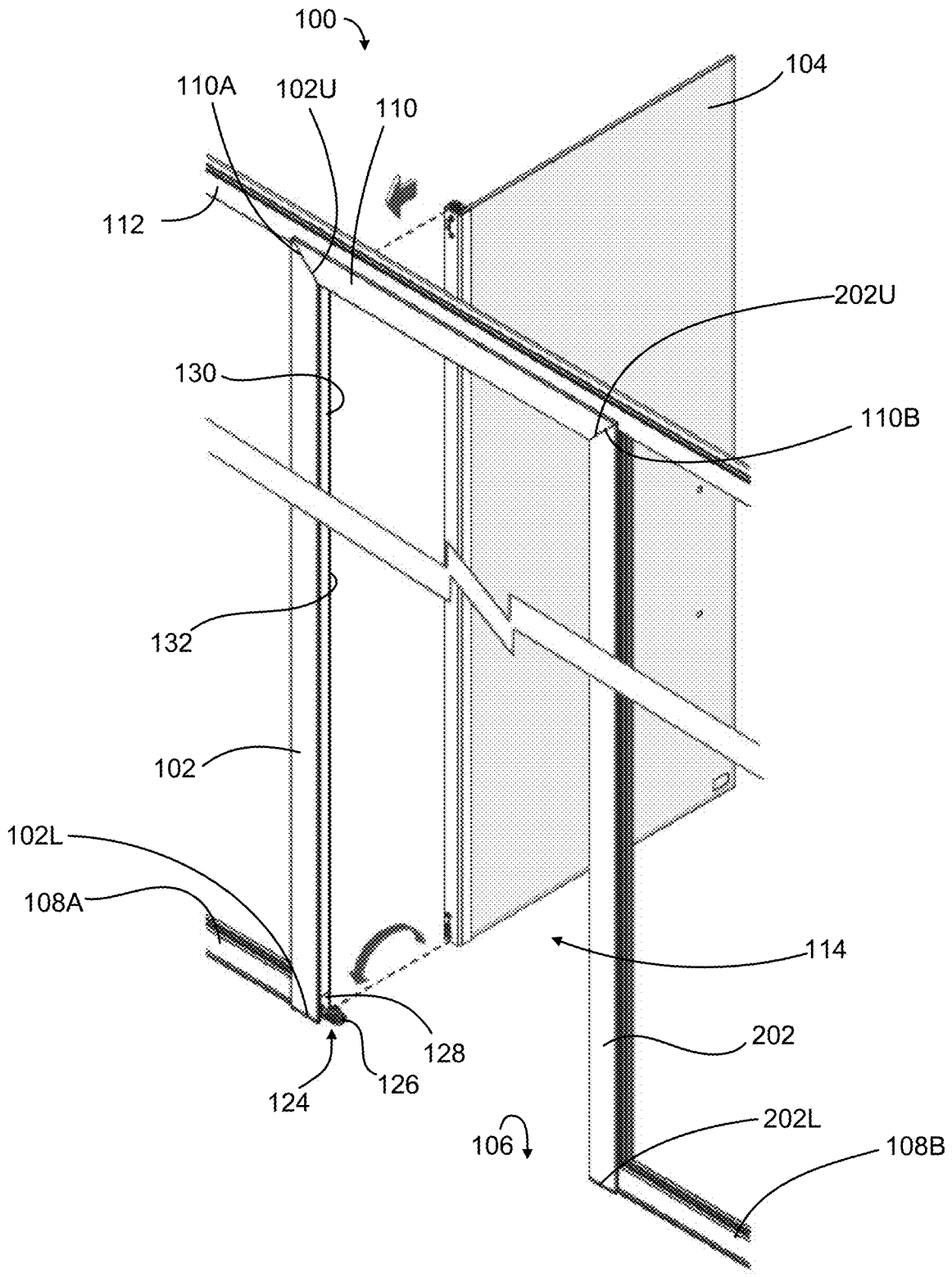
FIG. 8 is a perspective view of the door frame of FIG. 1 with an exemplary pivot door positioned for securement to a jamb assembly.

Turning to FIG. 8, once cap members 130 and 160 are respectively secured to the first and third jamb channels 102 and 110, e.g. as described above, a pivot door 104 may be rotatably mounted to the jamb assembly 100. In the illustrated example, a lower end of the pivot door 104 is rotatably mounted to the lower pivot assembly 124, and an upper end of the pivot door 104 is rotatably mounted to an upper bracket (not shown).

Pivot door 104 includes a door latch (not visible in FIG. 8) located at an edge thereof. Such a door latch may engage a receiving notch or aperture defined in the second jamb channel 202 to hold and/or lock the door in a closed position. Pivot doors may be made from any suitable material, and may be e.g. transparent, translucent, or opaque. In the illustrated example, pivot door 104 is made from a glass material. Once the pivot door 104 has been rotatably mounted to the jamb assembly 100, it may be selectively pivoted about a pivot axis 174 between a closed position (FIG. 9) and an open position (e.g. FIGS. 10 and 11).

A strike plate may be secured to the second jamb channel 202 to engage the door latch. Such a strike plate may define a latch-receiving cavity positioned to receive the door latch of the pivot door 104. It will be appreciated that misalignment of the door latch and the latch-receiving cavity of the strike plate may impair the performance of the pivot door 104.

Referring to FIG. 9, the pivot door 104 is shown in the closed position. In the closed position, an installer may determine a desired position to attach the strike plate to the second jamb channel 202. The desired position may be a position in which the door latch and the latch-receiving cavity of the strike plate generally align with one another. Accordingly, once the strike plate is secured in the desired position, the latch-receiving cavity may receive the door latch when the pivot door 104 is moved to the closed position. For example, to determine the desired location to attach the strike plate, when the pivot door 104 is in the closed position, the installer can mark a location 176 on the second jamb channel 202 that corresponds to the position of the door latch. The installer can then attach the strike plate to the second jamb channel 202 such that latch-receiving cavity is aligned with the location 176 previously marked on the second jamb channel 202. Therefore, the installer may ensure the door-receiving cavity of the strike plate is substantially aligned with the door latch when pivot door 104 is in the closed position.

From a manufacturing and installation perspective, it may be convenient for the first and second jamb channels 102 and 202 to be structurally similar, or even identical, to each other. In such embodiments, manufacturing costs may be reduced since only one part is being made as opposed to two. In the illustrated example, the first and second jamb channels 102 and 202 are cut from a single jamb extrusion (not shown). It will be appreciated that using the same material for the first and second jamb channels 102 and 202 may simplify installation. Accordingly, once installed, the first and second jamb channel 102 may have transverse cross-sections that are substantially a mirror images of each other.

Unless otherwise noted, like-numbered elements (i.e. elements having reference numerals that share two least-significant digits or two least significant digits and an alphabetic character, where applicable) have a similar structure and/or perform a similar function. For example, outer interior space 216*o* is analogous to outer interior space 116*o*.

Figure 10:
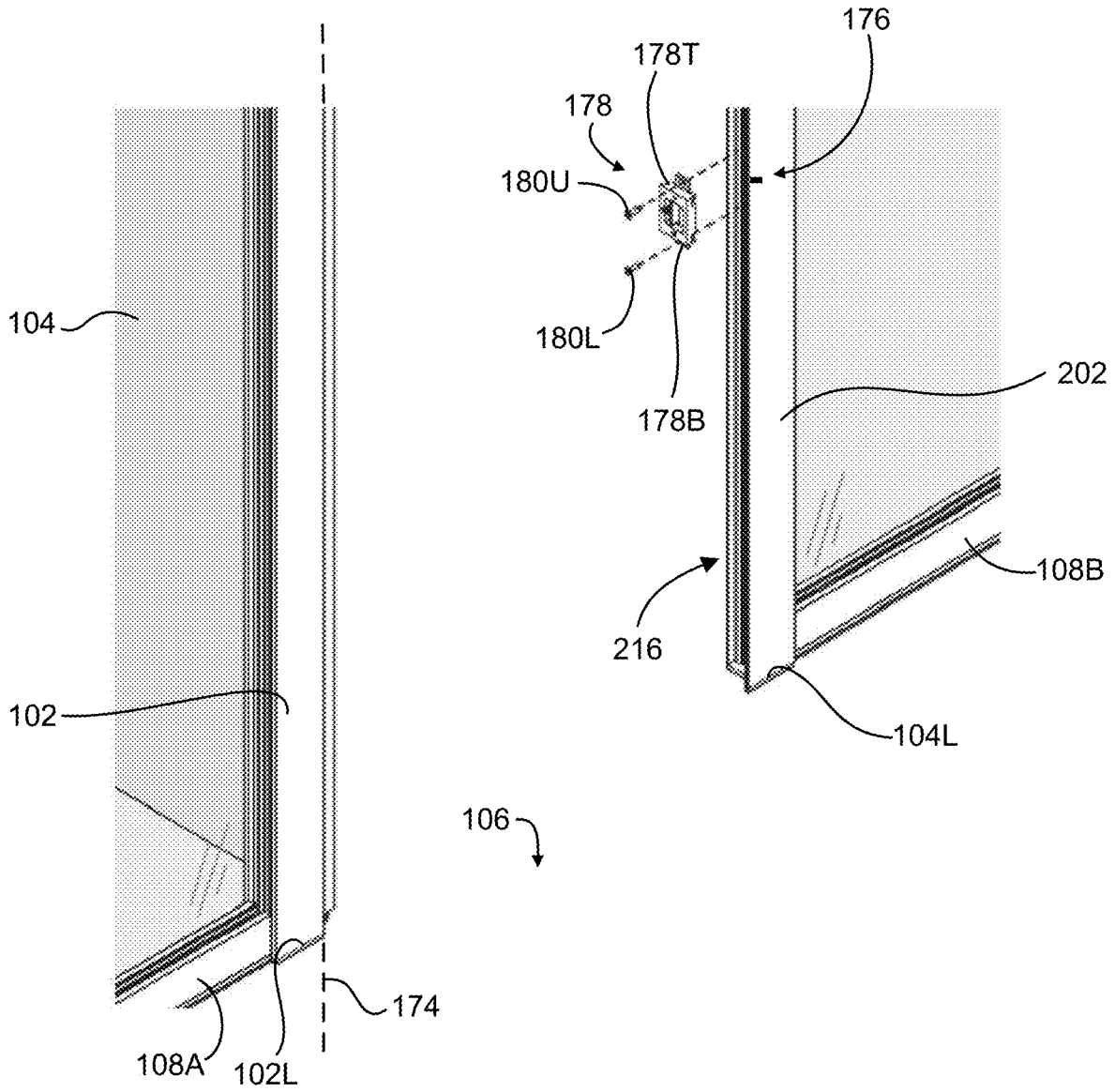
FIG. 10 is a perspective view of a lower portion of the door frame of FIG. 1 with a strike plate assembly positioned for securement to a second vertical jamb channel.

Referring to FIG. 10, a strike plate assembly 178 is aligned with the location 176 marked on the second jamb channel 202. The strike plate assembly 178 may be secured to the second jamb channel 202 in a number of suitable ways, e.g., using mechanical fasteners, an adhesive, or the like. In the illustrated example, the strike plate assembly 178 is secured to the second jamb channel 202 using upper and lower fasteners 180U and 180L. When secured to the second jamb channel 202, the strike plate assembly 178 is at least partially located within the interior space 216.

Figure 11:
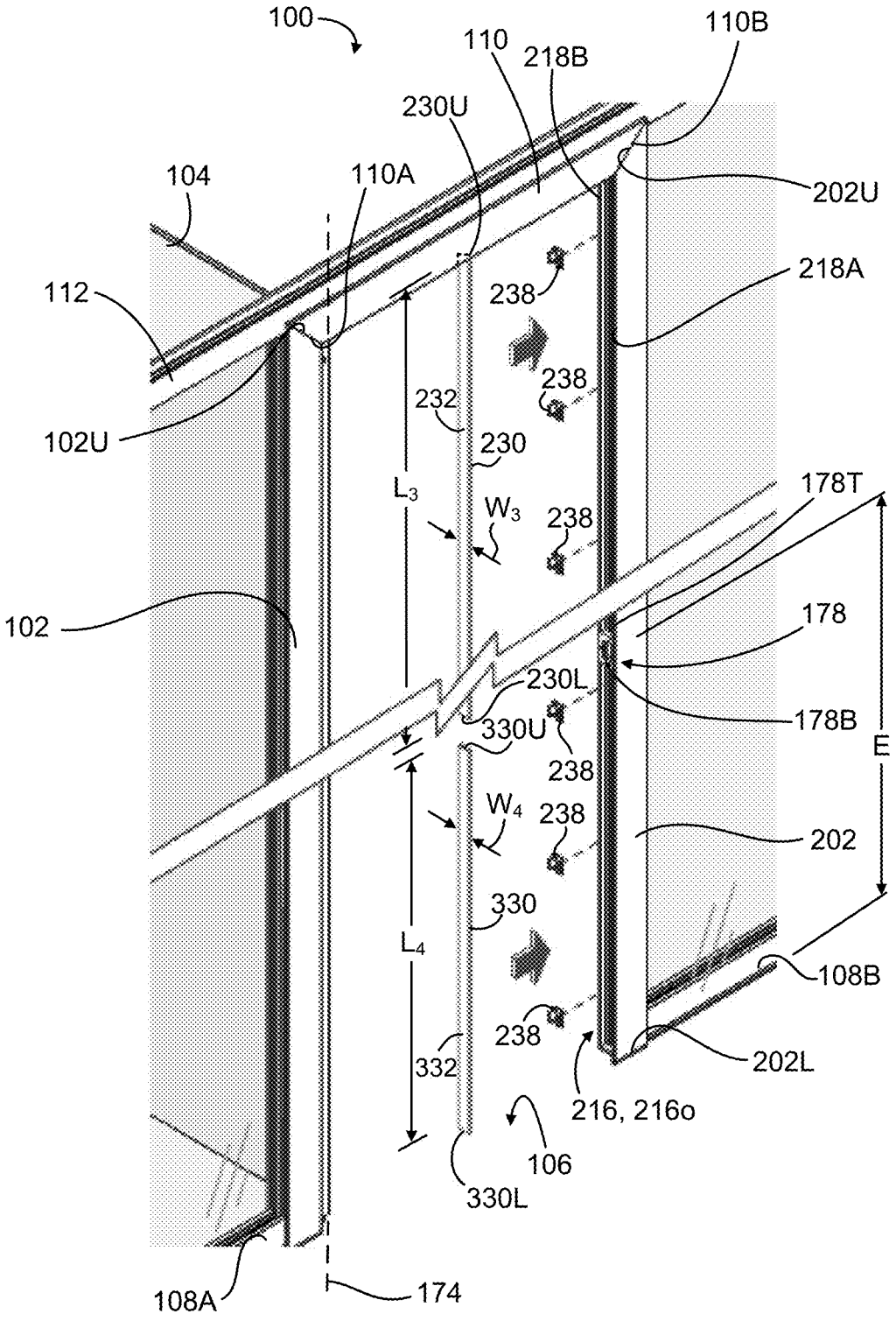
FIG. 11 is another partially exploded perspective view of the door frame of FIG. 1.

Referring to FIG. 11, the strike plate assembly 178 is secured to the second jamb channel 202 at an elevation E above the floor surface 106. It will be appreciated that elevation E may vary across embodiments based on a number of factors, e.g. location of the door latch, type of pivot door 104, varying floor to ceiling dimension, alignment of the first and second vertical jambs 102 and 202, etc.

With continued reference to FIG. 11, an elongate cap member 230 and an elongate cap member 330 are longitudinally aligned with the second jamb channel 202. In this arrangement, the cap members 230 and 330 may be received in the interior space 216 of second jamb channel 202.

Cap members 230 and 330 may be structurally similar, or identical, to cap member 130. In some cases, cap members 130, 230, and 330 may be cut from a single cap member extrusion (e.g. cap member extrusion 130'). In the illustrated example, cap members 230 and 330 have identical transverse cross-sections to the transverse cross-section of cap member 130.

The cap member 230 has a length $L_3$ between an upper end 230U and a lower end 230L thereof. Similarly, cap member 330 has a length $L_4$ between an upper end 330U and a lower end 330L thereof. The length $L_3$ of cap member 230 and the length $L_4$ of cap member 330 may be dimensioned so that they substantially enclose the interior space 216 above and below the strike plate assembly 178.

With continued reference to FIG. 11, the cap member 230 has a width $W_3$ that is slightly smaller than a width of the outer interior space 216*o* of second jamb channel 202. Similarly, the cap member 330 has a width $W_4$ that is slightly smaller than the width of the outer interior space 216*o*. Therefore, when the cap members 230 and 330 are secured to the second jamb channel 202, the width $W_3$ and the length $L_3$ of cap member 230 are dimensioned to substantially enclose the interior space 116 above the strike plate assembly 178 while the width $W_4$ and the length $L_4$ of cap member 330 are dimensioned to substantially enclose the interior space 116 below the strike plate assembly 178. In one or more alternative embodiments, width $W_3$ and/or $W_4$ may be noticeably less than the width of the outer interior space 216*o* to provide a different aesthetic.

Figure 12:
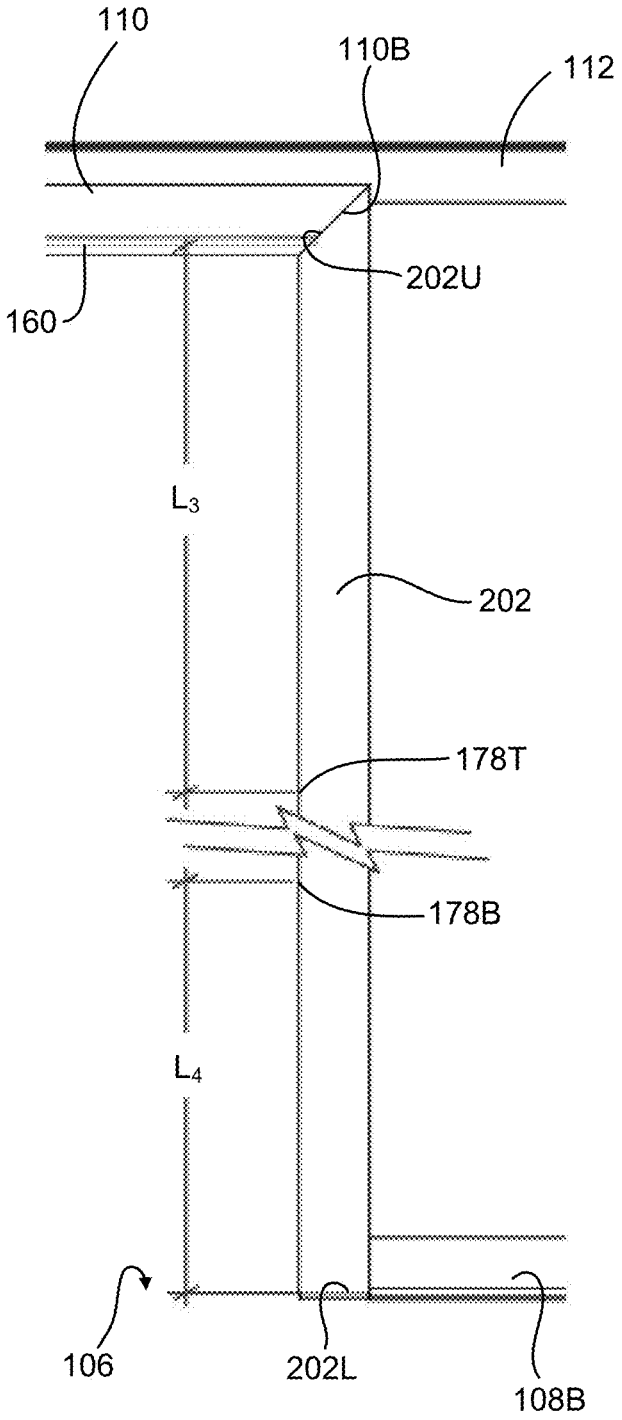
FIG. 12 is a partial elevation view of the other side of the door frame of FIG. 1.

Referring to FIG. 12, the length $L_3$ of cap member 230 may be determined by measuring the length between the cap member 160 and a top end 178T the strike plate assembly 178. Similarly, the length $L_4$ of cap member 330 may be determined by measuring the length between a bottom end 178B the strike plate assembly 178 and the floor surface 106.

Figure 13:
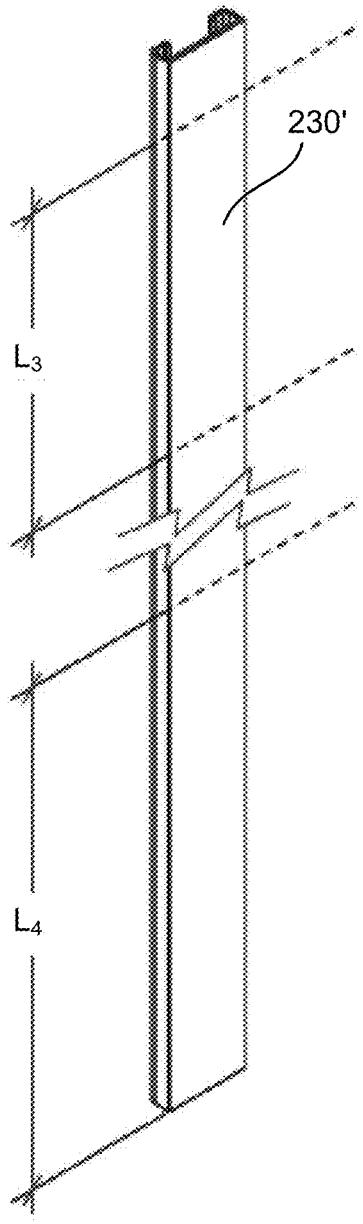
FIG. 13 is a perspective view of another exemplary cap member extrusion.

Referring to FIG. 13, a single cap member extrusion 230' can be cut to the measured lengths $L_3$ and $L_4$ to provide the cap members 230 and 330. In this context, the cap member extrusion 230' may be one of many standardized caps stored in an inventory and/or warehouse available to an installer. Those skilled in the art will appreciate that the cap member extrusion 230' selected by the installer preferably has a length equal to or longer than sum of lengths $L_3$ and $L_4$. In the illustrated example, the cap member extrusion 230' has a length that is longer than the sum of lengths $L_3$ and $L_4$.

In some cases, the cap member extrusion 230' can be cut to length on site. In such cases, an installer may bring the cap member extrusion 230' or several cap member extrusions 230' with varying dimensions to the installation site. For example, after measuring lengths $L_3$ and $L_4$, the installer can select the desired cap member extrusion 230' and cut it to the measured lengths to provide the cap members 230 and 330 with lengths $L_3$ and $L_4$, respectively. Alternatively, the cap member extrusion 230' may be cut off site to provide the cap members 230 and 330 with lengths $L_3$ and $L_4$, respectively.

It will be appreciated the selected cap member extrusion may also be shorter than the sum of the lengths $L_3$ and $L_4$. In such cases, two cap member extrusions (e.g. 230') may be needed to provide cap members 230 and 230 (i.e. one cut to provide cap member 230 with length $L_3$ and the other cut to provide cap member 330 with length $L_4$).

Referring again to FIG. 11, clips 238 are used to secure to cap members 230 and 330 to the second jamb channel 202 and to locate the cap members 230 and 330 at least partially within the outer interior space 216*o*. In the illustrated example, clips 238 are the same as clips 138 used to secure cap member 130 to the first jamb channel 102 (e.g. clips 138 and 238 have a common design). Accordingly, the clips 238 may be snap fit to the second jamb channel 202 in the same way as the clips 138 are snap fit to the first jamb channel 102. Similarly, cap members 230 and 330 may be snap fit to clips 238 in the same way cap member 130 are snap fit to clips 138. It will be appreciated that in one or more alternative embodiments, the clips 138 and 238 may differ from each other.

When the cap members 230 and 330 are secured to the second jamb channel 202, the cap members 230 and 330 are at least partially located within the outer interior space 216*o*. Preferably, when the cap members 230 and 330 are secured to the second jamb channel 202, the planar surfaces 232 and 332 of corresponding cap members 230 and 330 are substantially flush with distal edges of opposing walls 218A and 2186. In this arrangement, cap members 230 and 330 do not protrude from first jamb channel 202 and are fully located within the outer interior space 216*o*. This arrangement may also provide the second jamb channel 202 with a smoother visual appearance.

Figure 14:
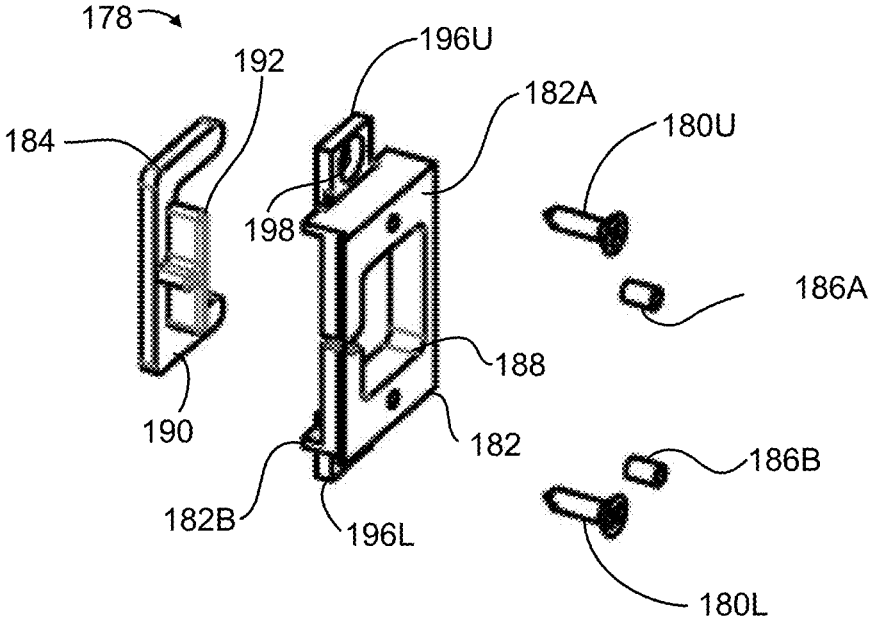
FIG. 14 is an exploded perspective view of the strike plate assembly of FIG. 10.
Figure 15:
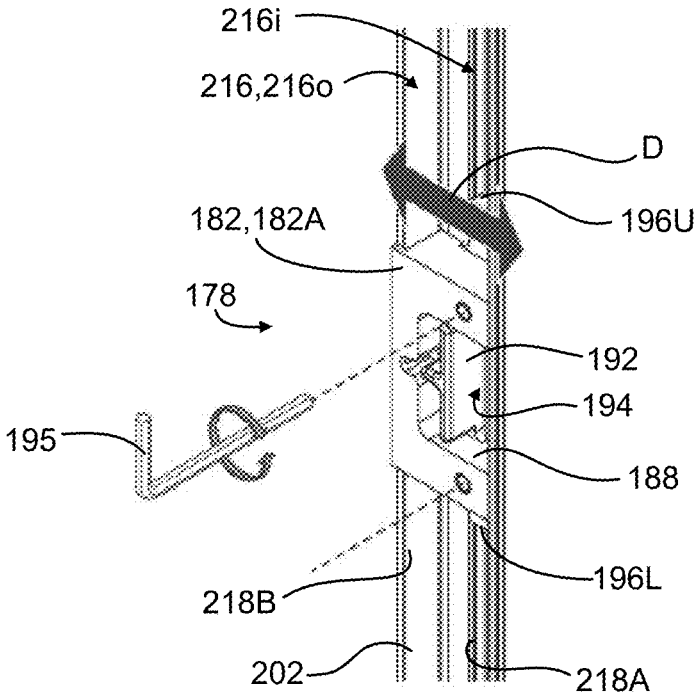
FIG. 15 is a perspective view of the strike plate assembly of FIG. 10 installed in the second vertical jamb channel.

Reference is now made to FIGS. 14 and 15 to describe the strike plate assembly 178. As will be described in more detail below, the strike plate assembly 178 may be used to adjust or "fine-tune" the position of the latch-receiving cavity defined by the strike plate assembly 178.

Strike plate assembly 178 includes a main plate 182, a sliding plate 184, and a pair of locking fasteners (e.g. set screws 186A and 186B). As shown in FIG. 14, the main plate 182 has a planar door-facing surface 182A and an opposed surface 1826 opposite the door-facing surface 182A. The main plate 182 also has an aperture 188 that extends from the door-facing surface 182A through the opposed surface 182B. The sliding plate 184 has a planar body 190 and an elongate tab 192 that projects generally perpendicularly from the body 190.

Referring to FIG. 15, the tab 192 is received in the aperture 188 of main plate 182. In such a configuration, the tab 192 and the aperture 188 define a door-latch receiving cavity 194. The door latch-receiving cavity 194 receives the door latch of pivot door 104 when the pivot door 104 is moved to the closed position (e.g. FIG. 9). As shown, the tab 192 is preferably dimensioned to extend from the top to the bottom of aperture 188.

The set screws 188A and 188B secure the sliding plate 184 to the main plate 182 in one of an unlocked configuration and a locked configuration. In the unlocked configuration, the body 190 is slideable along the opposed surface 1826 of the main plate 182 to adjust the position of the door latch-receiving cavity 194. Conversely, in the locked configuration, the set screws 188A and 188B lock the body 190 to the main plate 182 such that relative movement therebetween is inhibited or prevented. Put another way, when the sling plate 184 is secured to the main plate 182 the locked configuration, the position of the latch-receiving cavity 194 is fixed. In one or more alternative embodiments, one only locking fastener may be used.

Each of the set screws 188A and 188B preferably include a hex-shaped axial opening (not shown) defined in an end thereof. As shown in FIG. 15, an Allen key 195 may used to tighten or loosen the set screws 188A and 1886 via their hex-shaped axial openings to move between the locked and unlocked configurations. The threading of the set screws 188A and 188B is omitted for clarity.

Referring to FIG. 15, when the sliding plate 184 is secured to the main plate 182 in the unlocked configuration, the sliding plate 184 may be actuated by sliding the tab 192 in a direction D to adjust the position of the door-latch receiving cavity 194. Once the door-latch receiving cavity 194 is positioned as desired, the set screws 188A and 1886 may be tightened until the sliding plate 184 is secured to the main plate 182 in the locked configuration.

Referring again to FIG. 14, the main plate 182 has upper and lower connectors 196U and 196L that project from opposite ends of the opposed surface 182B. As shown in FIG. 15, when the strike plate assembly 178 is secured to the second jamb channel 202, the upper and lower connectors 196U and 196L are located within the inner interior space 216*i*.

Returning to FIG. 14, upper and lower flanges 196U and 196L each have an opening 198 defined therethrough. As described above, the strike plate assembly 178 is secured to the second jamb channel 202 with upper and lower fasteners 180U and 180L. The threading of the upper and lowers fasteners 180U and 180L is omitted for clarity. The upper fastener 180U passes through the opening 198 defined through upper connector 198U to engage the base wall 222C of second jamb channel 202. Similarly, the lower fastener 180L passes through the opening defined through the lower connector 196L to engage the base wall 222C of second jamb channel 202. It will be appreciated that in one or more alternative embodiments, only one fastener may be used to secure the strike plate assembly 178 to the second jamb channel 202.

As used herein, the wording "and/or" is intended to represent an inclusive-or. That is, "X and/or Y" is intended to mean X or Y or both, for example. As a further example, "X, Y, and/or Z" is intended to mean X or Y or Z or any combination thereof.

While the above description describes features of example embodiments, it will be appreciated that some features and/or functions of the described embodiments are susceptible to modification without departing from the spirit and principles of operation of the described embodiments. For example, the various characteristics which are described by means of the represented embodiments or examples may be selectively combined with each other. Accordingly, what has been described above is intended to be illustrative of the claimed concept and non-limiting. It will be understood by persons skilled in the art that other variants and modifications may be made without departing from the scope of the invention as defined in the claims appended hereto. The scope of the claims should not be limited by the preferred embodiments and examples, but should be given the broadest interpretation consistent with the description as a whole.

The invention claimed is:

1. A jamb assembly for a door frame, the jamb assembly comprising:

an elongate jamb channel defining an interior space, wherein a pair of opposing spaced apart ridges extend partially into the interior space leaving a gap therebetween, wherein the ridges divide the interior space into an outer interior space and an inner interior space;

an elongate cap member comprising a planar surface and a pair of spaced apart opposing in-turned portions, wherein the planar surface and the in-turned portions define a trough;

a clip for securing the cap member to the jamb channel and to locate the cap member at least partially within the outer interior space and with the planar surface facing an opening defined by the door frame, the clip comprising:

a base;

a pair of opposed spaced apart resilient tabs extending from the base; and a pair of spaced apart retaining portions extending from the base, each retaining portion comprising a proximate resilient portion and a distal wing portion, wherein each wing portion is turned-in in relation to the resilient portion;

wherein, when the base is located in the inner interior space, the tabs abut the ridges and the resilient portions are biased to engage the ridges;

wherein the resilient portions of the clip are configured to deform to allow the wing portions to pass between the in-turned portions of the cap member and locate in the trough, wherein the resilient portions are biased to engage the in-turned portions.

2. The jamb assembly of claim 1, wherein the clip is releasably secured to the jamb channel.

3. The jamb assembly of claim 1, wherein the cap member is releasably secured to the clip.

4. The jamb assembly of claim 1, wherein the clip is configured to snap fit to the jamb channel and, wherein the cap member is configured to snap fit to the clip.

5. The jamb assembly of claim 1, wherein the tabs are configured to extend from the base in a direction away from the jamb channel when secured to the jamb channel.

6. The jamb assembly of claim 1, wherein the resilient portions and the tabs are configured to extend in a generally similar direction away from the base.

7. The jamb assembly of claim 1, wherein the jamb channel comprises a pair of opposing walls, each wall having a distal edge, wherein, when the cap member is secured to the jamb channel, the planar surface of the cap member is substantially flush with the distal edges of the walls.

8. The jamb assembly of claim 1, wherein each in-turned portion of the cap member comprises a lip at a distal end thereof, the lip having an inclined surface, wherein, when the cap member is secured to the clip, the inclined surface of each lip is generally parallel to the adjacent resilient portion of the clip.

9. The jamb assembly of claim 1 comprising a plurality of the clips, wherein each clip secures the cap member to the jamb channel at a predetermined location along a length thereof.

10. The jamb assembly of claim 1 further comprising at least two of the elongate cap members, at least two of the clips, and a strike plate assembly for receiving a door latch, wherein the strike plate assembly is configured to be located within the jamb channel at a predetermined location along a length thereof, wherein one of the at least two clips secures one of the two elongate cap members to the jamb channel above the strike plate assembly, and wherein the other of the at least two clips secures the other of the two elongate cap members to the jamb channel below the strike plate assembly.

11. The jamb assembly of claim 10, wherein the one of the two elongate cap members substantially encloses the outer interior space of the jamb channel above the strike plate assembly and the other of the two elongate cap members substantially encloses the outer interior space of the jamb channel below the strike plate assembly.

12. The jamb assembly of claim 10, wherein the strike plate assembly comprises:

a main plate having a door-facing surface, an opposed surface opposite the door-facing surface, and an aperture defined therethrough;

a sliding plate having a planar body and an elongate tab projecting generally perpendicularly from the body, wherein, when the tab is received in the aperture of the main plate, the tab and aperture collectively define a door latch-receiving cavity; and, at least one locking fastener configured to secure the sliding plate to the main plate in one of an unlocked configuration and a locked configuration, wherein, in the unlocked configuration, the body is slideable along the opposed surface of the main plate to adjust a position of the door latch-receiving cavity, and wherein, in the locked configuration, the body is fixed relative to the main plate.

13. The jamb assembly of claim 12, wherein, in the unlocked configuration, the sliding plate is actuated by sliding the tab.

14. The jamb assembly of claim 12, wherein the main plate of the strike plate assembly is secured to jamb channel with at least one fastener.

* * * * *